US006338336B1

(12) United States Patent
Iida

(10) Patent No.: US 6,338,336 B1
(45) Date of Patent: Jan. 15, 2002

(54) ENGINE AIR-FUEL RATIO CONTROL WITH FUEL VAPOR PRESSURE-BASED FEEDBACK CONTROL FEATURE

(75) Inventor: Hisashi Iida, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/369,387

(22) Filed: Aug. 6, 1999

(30) Foreign Application Priority Data

Sep. 4, 1998 (JP) ..... 10-251286

(51) Int. Cl.[7] ..... F02D 41/14
(52) U.S. Cl. ..... 123/674; 123/698; 123/520
(58) Field of Search ..... 123/674, 698, 123/520

(56) References Cited

U.S. PATENT DOCUMENTS 5,357,934 A 10/1994 Iida et al. ..... 123/520
5,406,927 A 4/1995 Kato et al. ..... 123/674
5,520,160 A * 5/1996 Aota et al. ..... 123/675
5,623,914 A 4/1997 Kawamoto et al. ..... 123/689
5,680,849 A * 10/1997 Morikawa et al. ..... 123/520
6,105,556 A * 8/2000 Takaku et al. ..... 123/520
6,109,225 A * 8/2000 Ogita et al. ..... 123/90.15

* cited by examiner

*Primary Examiner*—Henry C. Yuen
*Assistant Examiner*—Arnold Castro
(74) *Attorney, Agent, or Firm*—Nixon & Vanderhye P.C.

(57) ABSTRACT

A method and apparatus for controlling the air-fuel ratio of an internal combustion engine that prevents erroneous learning while properly setting a learning frequency to thereby execute highly accurate air-fuel ratio control. Fuel vapor generated in a fuel tank is temporarily adsorbed in a canister via a tank inner pressure-regulating valve, and the adsorbed vapor is discharged to an engine intake system via a purge solenoid valve. A sensor for detecting tank inner pressure is arranged in the fuel tank, and an ECU calculates a feedback correction amount based on an oxygen concentration in exhaust gas and executes air-fuel ratio feedback control by using the feedback correction amount. The ECU prohibits the air-fuel ratio learning value from being updated when the tank inner pressure exceeds a predetermined criterion value based on the tank inner pressure detected by the tank inner pressure sensor.

11 Claims, 12 Drawing Sheets

ENGINE AIR-FUEL RATIO CONTROL WITH FUEL VAPOR PRESSURE-BASED FEEDBACK CONTROL FEATURE

CROSS-REFERENCE TO RELATED APPLICATION

The present application is related to, and claims priority from, Japanese Patent Application No. Hei. 10-251286, the contents of which are incorporated herein by reference.

BACKGROUND OF THE INVENTION

1. Field of the Invention

The present invention relates to an air-fuel ratio control apparatus of an internal combustion engine, and particularly to an apparatus having a mechanism for discharging adsorbed fuel vapor that carries out air-fuel ratio feedback control based on fuel vapor amount and fuel tank pressure.

2. Related Art

A conventional air-fuel ratio control apparatus is disclosed in, for example, Japanese Patent Application Laid-Open No. 8-14089. According to such an apparatus, an air-fuel ratio feedback correction amount is calculated, a stored air-fuel ratio learning value is read, and air-fuel ratio feedback control is carried out by using the air-fuel ratio feedback correction amount and the air-fuel ratio learning value. Further, fuel temperature in a fuel tank is detected. When the air-fuel ratio feedback control is carried out and a detected value of the fuel temperature is less than a predetermined temperature, the air-fuel ratio learning value is updated by using the air-fuel ratio feedback correction amount. Meanwhile, when air-fuel ratio feedback control is carried out and the detected value of the fuel temperature is equal to or higher than the temperature criterion value, updating of the air-fuel ratio learning value is prohibited. That is, when the detected value of the fuel temperature is higher than the temperature criterion value and a large amount of fuel vapor is generated in the fuel tank, fuel vapor introduced into an intake pipe is provided without being adsorbed to a canister, and erroneous learning operation by the fuel vapor is prevented.

However, generally, a relationship between fuel temperature and a fuel evaporation amount significantly differs depending on the kind of fuel. When the kind of fuel differs, volatility known by, for example, Reid vapor pressure RVP, differs. FIG. 15 is a diagram showing a relationship among fuel temperature (gasoline temperature), Reid vapor pressure and a fuel evaporation amount. As is evident from the diagram, as the gasoline temperature increases, or as the Reid vapor pressure increases, the fuel evaporation amount increases.

In this case, in the above-described conventional apparatus, when the temperature criterion value is set with fuel having high volatility (high RVP) as a reference, the temperature criterion value should be set to a small value (low temperature). However, as a result, updating of the air-fuel ratio learning value is normally prohibited. Further, when the temperature criterion value is set with fuel having low volatility (small RVP) as a reference, the temperature criterion value is set to a large value (high temperature), and erroneous learning is carried out.

SUMMARY OF THE INVENTION

Accordingly, it is an object of the present invention to provide an engine air-fuel ratio control apparatus capable of preventing erroneous learning while properly setting a learning frequency to thereby carry out highly accurate air-fuel ratio control.

The present invention is applied to an internal combustion engine having a fuel vapor discharging mechanism for temporarily adsorbing fuel vapor generated in a fuel tank in a canister and discharging the adsorbed fuel vapor to an engine intake system. In this environment, the present invention calculates a feedback correction amount based on an oxygen concentration in exhaust gas and executes air-fuel ratio feedback control by using the feedback correction amount.

More specifically, the present invention includes a controller that updates an air-fuel ratio learning value by using the feedback correction amount when the air-fuel ratio feedback control is being carried out. The controller also detects pressure in the fuel tank and prohibits updating of the air-fuel ratio learning value when the detected tank inner pressure exceeds a predetermined criterion value.

By prohibiting/permitting updating of the learning value based on tank inner pressure while monitoring an actual amount of fuel vapor fed to the side of the canister, the controller can properly update air-fuel ratio learning value in accordance with the amount of the fuel vapor. That is, even when various fuels having different volatilities are used, the determination can be properly carried out, even when a relationship between fuel temperature and a fuel evaporation amount significantly differs depending on the kind of fuel. As a result, erroneous learning is prevented, and highly accurate air-fuel ratio control can thus be carried out.

DETAILED DESCRIPTION OF THE PREFERRED EMBODIMENTS

An explanation will be given of a first embodiment of the present invention with reference to the drawings as follows.

Figure 1:
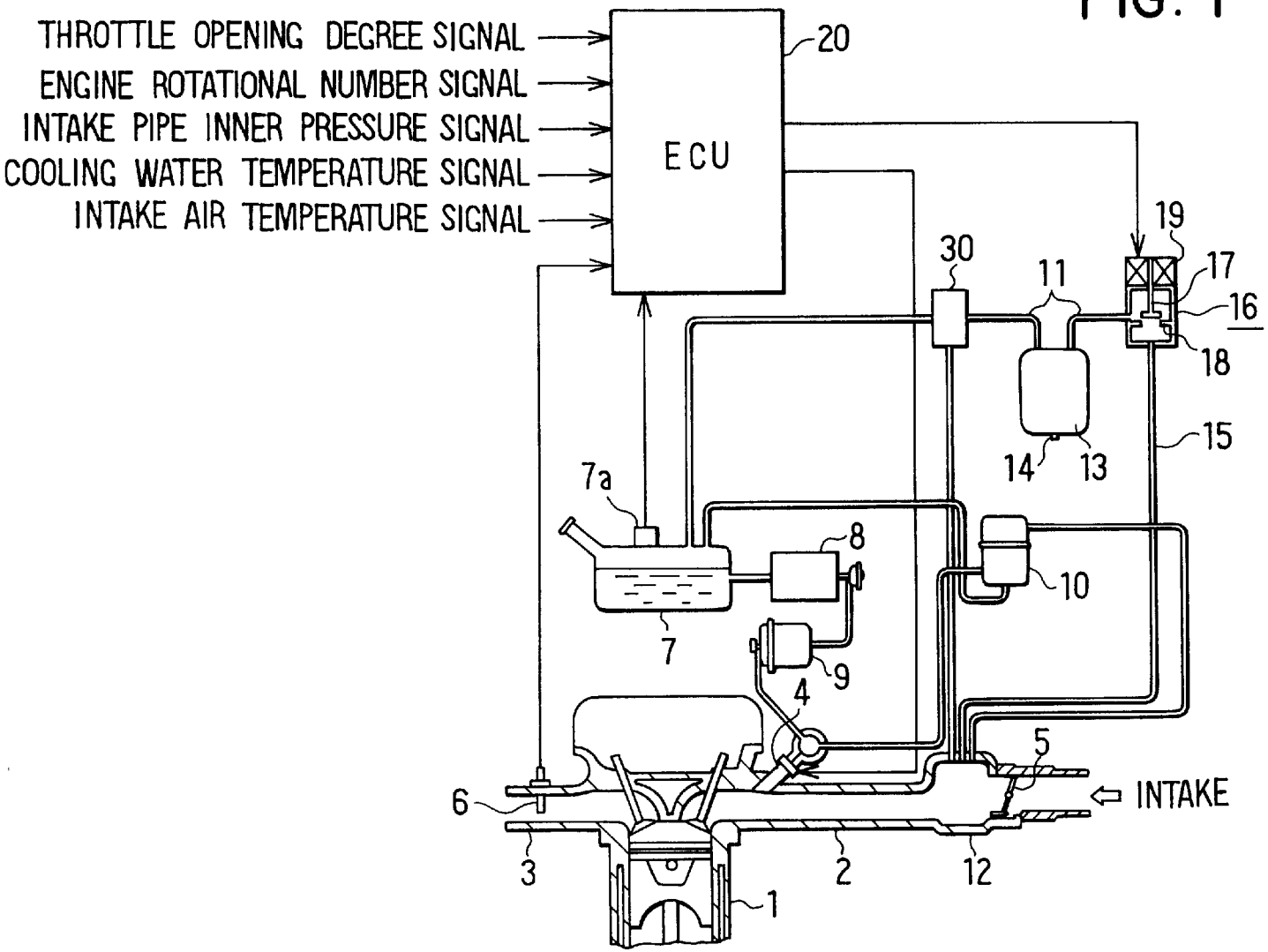
FIG. 1 is a schematic diagram showing an outline of an air-fuel ratio control system according to a first embodiment of the present invention.

The present invention is provided with a mechanism for temporarily adsorbing fuel vapor generated in a fuel tank in a canister, and discharging the adsorbed fuel vapor to an engine intake system for carrying out air-fuel ratio feedback (F/B) control to maintain a proper air-fuel ratio based in part on the amount of fuel vapor discharged to the engine intake system. Referring first to FIG. 1, an outline of an air-fuel ratio control system according to the embodiment is shown. An engine 1 is connected with an intake pipe 2 and an exhaust pipe 3. An electromagnetic driving type injector 4 is installed at an inner end portion of the intake pipe 2. Upstream therefrom, a throttle valve 5 is installed, and has an opening degree regulated in cooperation with an accelerator pedal, not illustrated. The exhaust pipe 3 is installed with an oxygen concentration sensor ($O_2$ sensor) 6 that outputs a voltage signal in accordance with an exhaust gas oxygen concentration.

A fuel supply system for supplying fuel to the injector 4 is installed with a fuel tank 7, a fuel pump 8, a fuel filter 9 and a pressure-regulating valve 10. Fuel in the fuel tank 7 is sucked by the fuel pump 8 and is pressurized to feed to the injectors 4 of the respective cylinders via the fuel filter 9. Further, fuel supplied to the injectors 4 of the respective cylinders is regulated to predetermined pressure by the pressure-regulating valve 10. A sensor 7*a* for detecting tank inner pressure is attached to the fuel tank 7.

A purge pipe 11 extends from an upper portion of the fuel tank 7 and communicates to a surge tank 12 of the intake pipe 2. The middle portion of the purge pipe 11 is arranged with a canister 13 containing activated carbon as an adsorbent for adsorbing evaporated fuel generated in the fuel tank 7. The canister 13 is installed with an atmosphere opening hole 14 for introducing outside air. The purge pipe 11 on a side of the surge tank 12 of the canister 13, forms a discharge path 15. A flow rate variable electromagnetic valve (hereinafter, referred to as purge solenoid valve) 16 is installed in the middle of the discharge path 15 as a purge control valve.

According to the purge solenoid valve 16, a valve member 17 is normally urged in a seat portion closing direction by a spring (not illustrated) and is moved in a seat portion opening direction by magnetizing a coil 19. That is, the purge solenoid valve 16 closes the discharge path 15 by demagnetizing the coil 19 and opens the discharge path 15 by magnetizing the coil 19. The operation of opening and closing the purge solenoid valve 16 is controlled by duty ratio control based on pulse width modulation by an electronic control unit (hereinafter, referred to as ECU 20). The opening degree of the purge solenoid valve 16 is regulated from a fully closed state to a fully opened state by the duty ratio control.

Therefore, when the canister 13 communicates with the intake pipe 2 by supplying a control signal from ECU 20 to the purge solenoid valve 16, fresh air is introduced into the canister 13 via the atmosphere opening hole 14. At this time, fuel vapor is transmitted from the intake pipe 2 into cylinders of the engine 1 to thereby carry out canister purging, and the adsorbing function of the canister 13 is recovered.

Further, a pressure-regulating valve 30 is arranged between the fuel tank 7 and the canister 13 for controlling a tank inner pressure by restraining the rise or fall of the tank inner pressure from exceeding allowable levels. Incidentally, a description will be given later of the structure of the tank inner pressure-regulating valve 30.

The ECU 20 is primarily includes a well-known microcomputer comprising CPU, ROM, RAM, backup RAM, as well as other conventional components, and receives as inputs a throttle opening degree signal, an engine rotational number signal, an intake pipe inner pressure signal, a cooling water temperature signal, an intake temperature signal and the like from a group of sensors, not illustrated, as well as detected signals from the tank inner pressure sensor 7*a* and the $O_2$ sensor 6. Further, the ECU 20 executes fuel injection control by carrying out respective air-fuel ratio F/B control, purge rate control, fuel vapor (evaporation fuel) concentration detection, air-fuel ratio learning control, fuel injection amount control and purge solenoid valve control.

Figure 2:
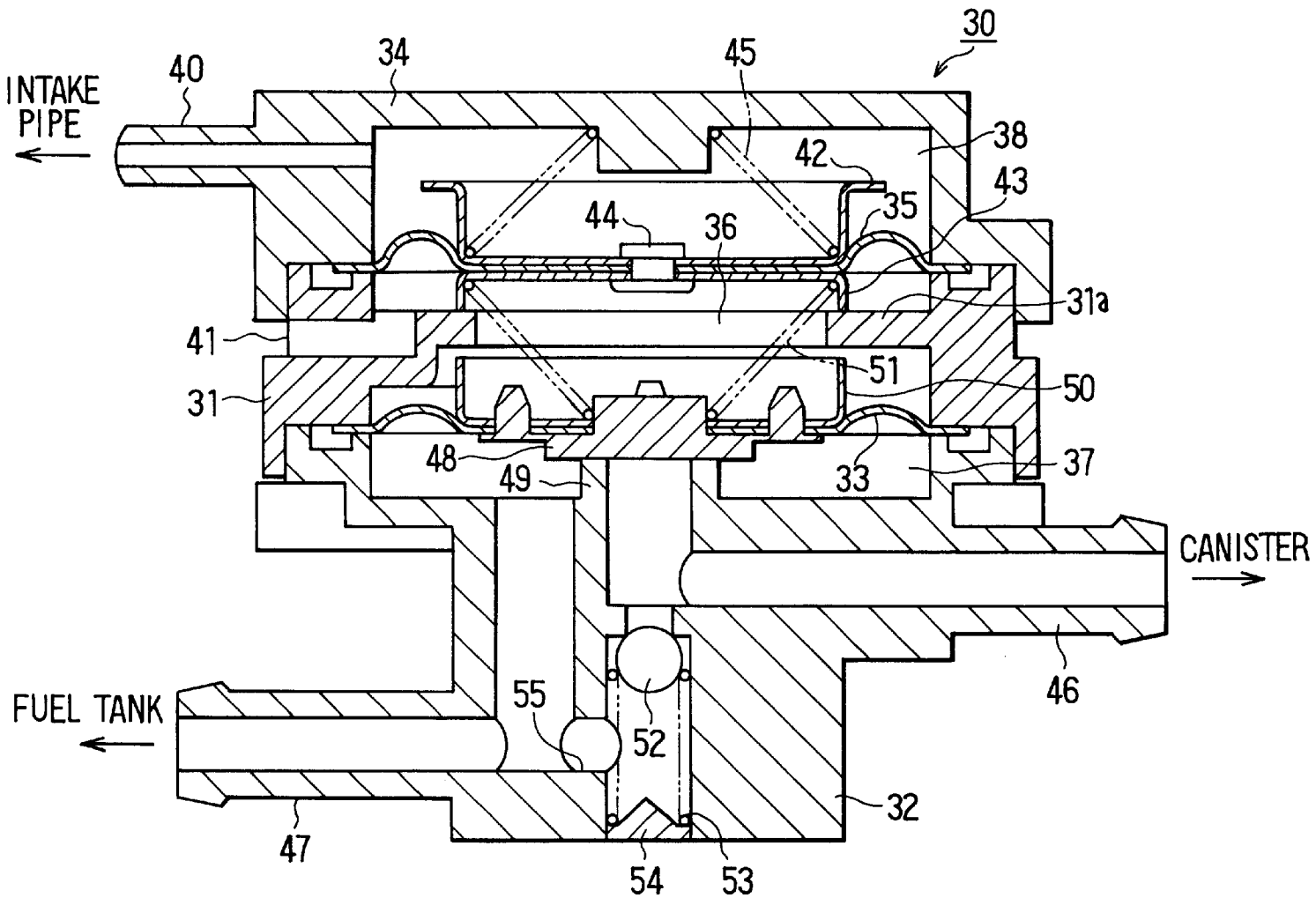
FIG. 2 is a cross-sectional view showing a tank inner pressure-regulating valve.

Next, an explanation will be given of the detailed structure of the tank inner pressure-regulating valve 30 with reference to FIG. 2. As shown in FIG. 2, an outer peripheral edge of a diaphragm 33 is fixedly sandwiched between a first housing 31 and a second housing 32, and an outer peripheral edge of a diaphragm 35 is fixedly sandwiched between the first housing 31 and a cover 34. In this case, an atmosphere chamber 36 and a fuel vapor chamber 37 are demarcated by the diaphragm 33 on the lower side the drawing, and the atmosphere chamber 36 and an intake chamber 38 are demarcated by the diaphragm 35 on the upper side of the drawing.

The cover 34 is formed with an intake port 40 for communicating the intake chamber 38 with the surge tank 12 of the intake pipe 2 (refer to FIG. 1). Further, the first housing 31 is formed with an atmosphere port 41 for communicating the atmosphere chamber 36 with the atmosphere. A side of the intake chamber 38 and a side of the atmosphere chamber 36 of the diaphragm 35 are respectively fixed with stoppers 42, 43 in a dish-like shape by a rivet 44. A spring 45 is installed between the stopper 42 and the cover 34. The load of the spring 45 is set such that it is contracted when negative pressure of the intake pipe 2 is applied on the intake chamber 38.

The second housing 32 is formed with a purge port 46 and a tank port 47 both communicating with the fuel vapor chamber 37. The purge port 46 communicates with the purge pipe 11 on the side of the canister 13 and the tank port 47 communicates with the purge pipe 11 on the side of the fuel tank 7 (refer to FIG. 1). Further, a valve member 48 is integrally installed with a central portion of the diaphragm 33. The fuel vapor chamber 37 and the purge port 46 are selectively communicated with each other by bringing the valve member 48 in contact with or separating the valve member 48 from a valve seat 49 of the second housing 32 forming an end of the purge port 46 opening to the fuel vapor chamber 37.

A dish-shaped stopper 50 is fixed to a side of the atmosphere chamber 36 of the diaphragm 33. A spring 51 is installed between the stopper 50 and the stopper 43 on the side of the diaphragm 35. The load of the spring 51 is set smaller than the load of the spring 45. In this case, the stopper 50 can be elevated to a position in contact with a lower face of a stepped portion 31*a* formed at the first housing 31 to rectify the valve member range of motion.

A lower portion of the second housing 32 is installed with a ball valve constituted by a ball 52, a spring 53 and a spring seat 54. When the fuel tank 7 becomes negative in pressure, the ball valve is for communicating the purge port 46 with the tank port 47 via a communication path 55 by lowering the ball 52 against the spring 53.

Further, the set load of the ball valve applied on the ball 52 is changed by replacing the spring 53 by which the negative pressure inside of the fuel tank 7 is regulated. Further, a screw may be formed at an outer periphery of the spring seat 54, and the position of the spring seat 54 relative to the second housing 32 may be adjusted. Also in this case, the negative pressure inside of the fuel tank 7 can be adjusted by changing the set load of the spring 53 applied on the ball 52.

According to the structure of the tank inner pressure-regulating valve 30, when the intake negative pressure is applied to the intake chamber 38, the diaphragm 35 is elevated by a difference between the intake negative pressure and the atmospheric pressure of the atmosphere chamber 36. That is, the diaphragm 35 is elevated until the stopper 42 is brought into contact with an inner wall face of the cover 34 against the spring 45. Then, the spring 51 is elongated by elevating the stopper 42. Accordingly, the set load applied on the diaphragm 33 is reduced.

Meanwhile, when the intake negative pressure is not applied to the intake chamber 38 and pressure of the intake chamber 38 becomes equal to the atmospheric pressure, the diaphragm 35 is lowered via the spring 45 until the stopper 43 is brought into contact with an upper face of the stepped housing portion 31*a*. Then, the spring 51 is compressed, and the set load applied on the diaphragm 33 is increased more than when the intake negative pressure is applied to the intake chamber 38.

Therefore, the set load of the spring 51 applied on the diaphragm 33 is reduced when the intake negative pressure is produced, and is increased when the intake negative pressure is not produced. Therefore, the inner pressure of the fuel tank is adjusted to a comparatively small value (P1) when the engine is operated and is adjusted to a comparatively large value (P2) when the engine is stopped.

An explanation of the operation of the tank inner pressure-regulating valve 30 will now be given with reference to FIG. 3, which shows a relationship between the tank inner pressure and a positive flow rate of fuel in accordance with opening the regulating valve 30.

Normally, the valve member 48 of the tank inner pressure-regulating valve 30 is disposed at a closed position (FIG. 2). When fuel in the fuel tank 7 starts evaporating, the tank inner pressure is increased. At this point, as indicated by a bold line in the drawing, when the engine is operated, when tank inner pressure exceeds "P1 (about 10 mmHg)", the tank inner pressure-regulating valve 30 is opened (the valve member 48 is moved to an opened position) and the fuel flow rate is increased. At this point, fuel vapor is adsorbed to the canister 13 by passing through the purge pipe 11 via the purge port 46, and is discharged into the intake pipe 2 by opening the purge solenoid valve 16 when a signal for conducting electricity is transmitted from the ECU 20.

In such a case, even when leakage occurs in the purge pipe 11 between the fuel tank 7 and the tank inner pressure-regulating valve 30, a large amount of fuel vapor is prevented from escaping into the atmosphere, as the tank inner pressure is regulated at a comparatively low predetermined pressure P1. Further, fuel vapor is prevented from flowing from the fuel tank 7 to the canister 13 if the vapor is at or below a predetermined pressure P1. Therefore, the size of the canister 13 need not be increased to prevent fuel vapor from flowing out from the atmosphere opening hole 14 into the atmosphere. Also, fuel does not flow into the canister 13 at pressure P1 or lower, and therefore deterioration of the canister adsorbent can be prevented.

Meanwhile, as shown by the two-dotted chain line in the drawings, when the engine is stopped, when the tank inner pressure exceeds "P2 (about 18 mmHg)", the tank inner pressure-regulating valve 30 is opened (the valve member 48 is moved to the opened position) and the fuel flow rate is increased. At this point, fuel vapor is adsorbed to the canister 13 by passing through the purge pipe 11 via the purge port 46. In such a case, the tank inner pressure is regulated to the comparatively high pressure P2. Therefore, fuel vapor is difficult to generate in the fuel tank 7, and fuel vapor does not flow into the canister 13 unless tank inner pressure becomes equal to or higher than P2. Therefore, fuel vapor is not excessively supplied to the canister 13, and an amount of fuel vapor adsorbed to the canister 13 can be reduced when the engine is stopped. As a result, the size of the canister 13 can be decreased, and the amount of fuel vapor that leaks into the atmosphere can be reduced.

Also, when the tank inner pressure exceeds "5 mmHg" when the engine is operated, or when the engine is stopped, fuel vapor starts to flow gradually; however, the flow rate is maintained at a de minimus level.

Figure 3:
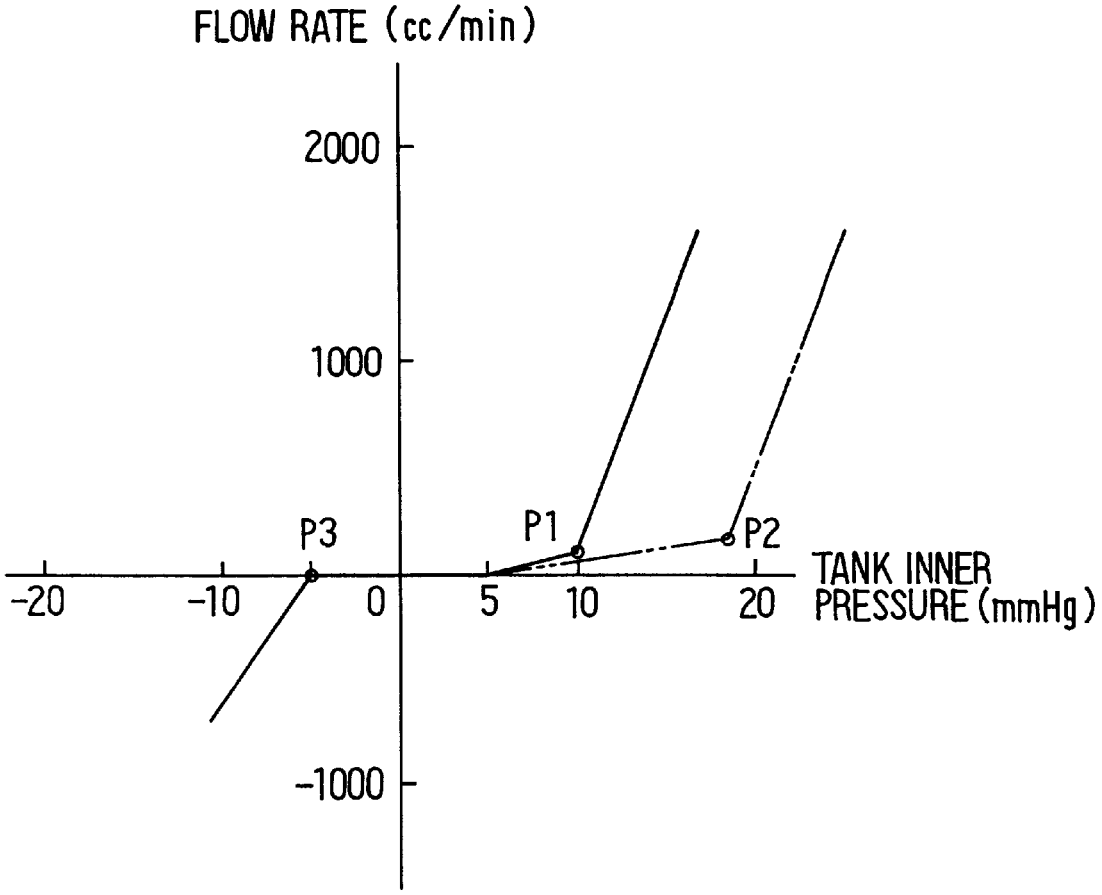
FIG. 3 is a graph of the flow rate of fuel vapor by the tank inner pressure-regulating valve versus inner tank pressure.

Further, when the tank inner pressure is lowered due to fuel vapor condensation accompanied by lowered tank temperature, and negative pressure is caused inside the fuel tank 7, the ball 52 of the tank inner pressure-regulating valve 30 is moved to a valve opening position against the spring 53, and the tank inner pressure is returned to the positive pressure side (pressure P3 in FIG. 3). In this case, the fuel tank 7 can be prevented from being deformed by the negative pressure. Further, the fuel vapor remaining in the canister 13 flows again into the fuel tank 7. Therefore, the amount of fuel vapor remaining in the canister 13 is reduced and the canister 13 can be downsized.

Next, a detailed explanation will be given of the operation of the air-fuel ratio control system described above. According to the system, fuel injection control is realized by carrying out respective processings of the air-fuel ratio F/B control (FIG. 4), the purge rate control (FIG. 5), the evaporation concentration detection (FIG. 6), determination of conditions of carrying out air-fuel ratio learning (FIG. 7), the air-fuel ratio learning control (FIG. 8), the fuel injection amount control (FIG. 9) and the purge solenoid valve control (FIG. 10) and an explanation will be given of the respective processings as follows.

(Air/fuel ratio F/B control)

Figure 4:
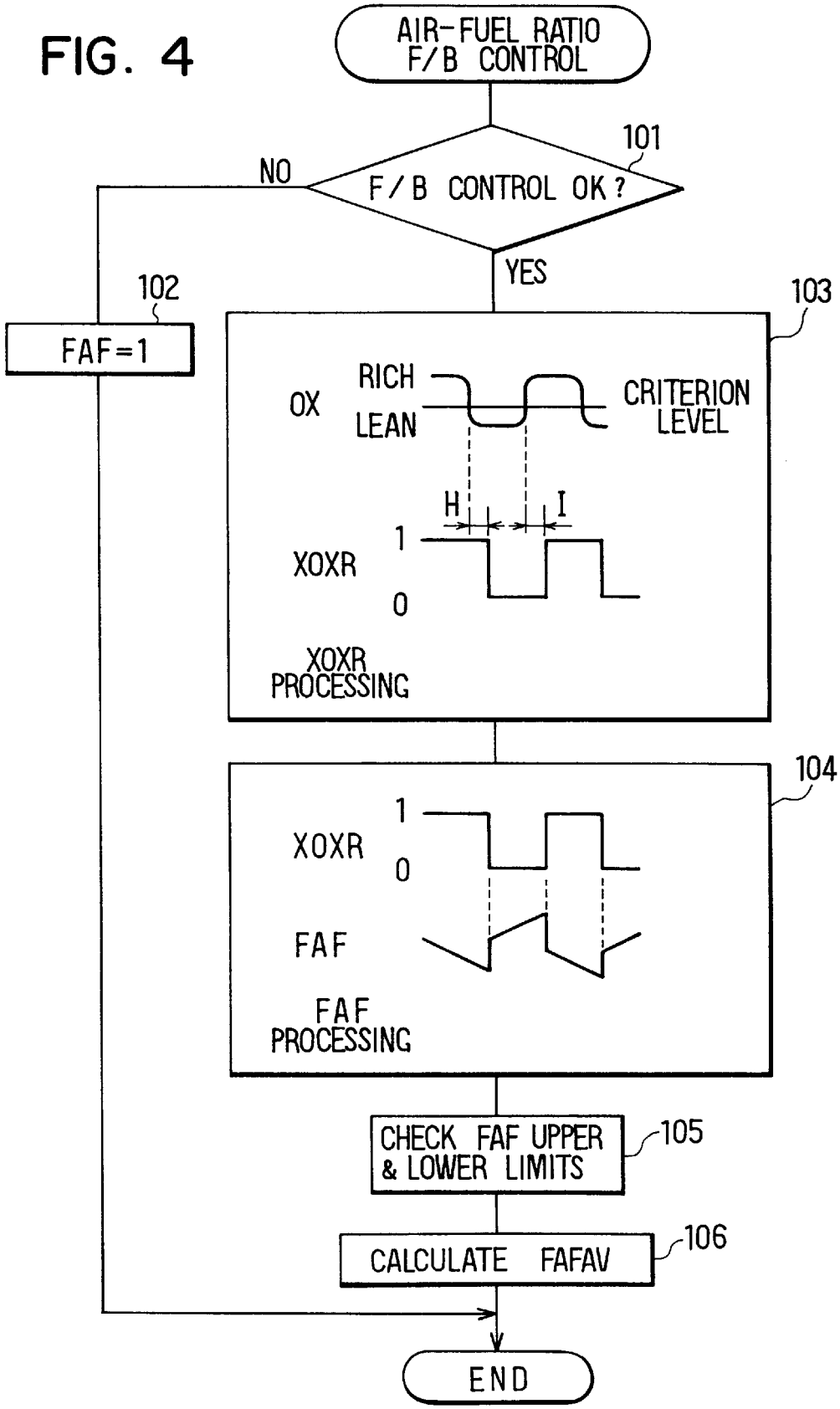
FIG. 4 is a flow diagram showing an air-fuel ratio F/B (feedback) control routine.

An explanation will first be given for the air-fuel ratio F/B control, with reference to the flow diagram of FIG. 4. Further, a routine of FIG. 4 is executed by time interruption, for example, every 4 msec by ECU 20.

At step 101, it is determined whether conditions of performing F/B control are established. In this case, it is determined that F/B control can be executed when the following respective conditions of (1)–(5) are all satisfied: (1) the engine is not being started; (2) fuel is not being cut; (3) cooling water temperature is THW≦40° C.; (4) TAU>TAUmin (notation TAUmin indicates a minimum fuel injection amount of the injector 4); and (5) the $O_2$ sensor 6 is brought into an activated state. When the determination is NO at step 101, an air-fuel ratio correction coefficient FAF is set to "1.0" at step 102, and the routine is temporarily finished.

When the determination is YES at step 101, an output from the $O_2$ sensor is compared with a predetermined criterion level, and an air-fuel ratio flag XOXR is generated for retarding purposes respectively by predetermined time periods H, I (msec) at step 103. Specifically, the flag is operated to "0" H msec after the output from the $O_2$ sensor is reversed from rich to lean and the flag is operated to "1" I msec after the output from the $O_2$ sensor is reversed from lean to rich.

Next, at step 104, a value of the air-fuel ratio correction coefficient FAF is operated based on the air-fuel ratio flag XOXR. That is, when the air-fuel ratio flag XOXR is changed, a predetermined amount of the FAF value is skipped, and the FAF value is controlled to integrate when the air-fuel ratio flag XOXR continues to be "1" or "0". Thereafter, at step 105, an upper and lower limit check of the FAF value is executed. At successive step 106, a rounded value FAFAV is calculated by executing a rounding (averaging) processing at every skip or at every predetermined time period based on the FAF value. Thereafter, the routine is finished.

(Purge rate control)

Figure 5:
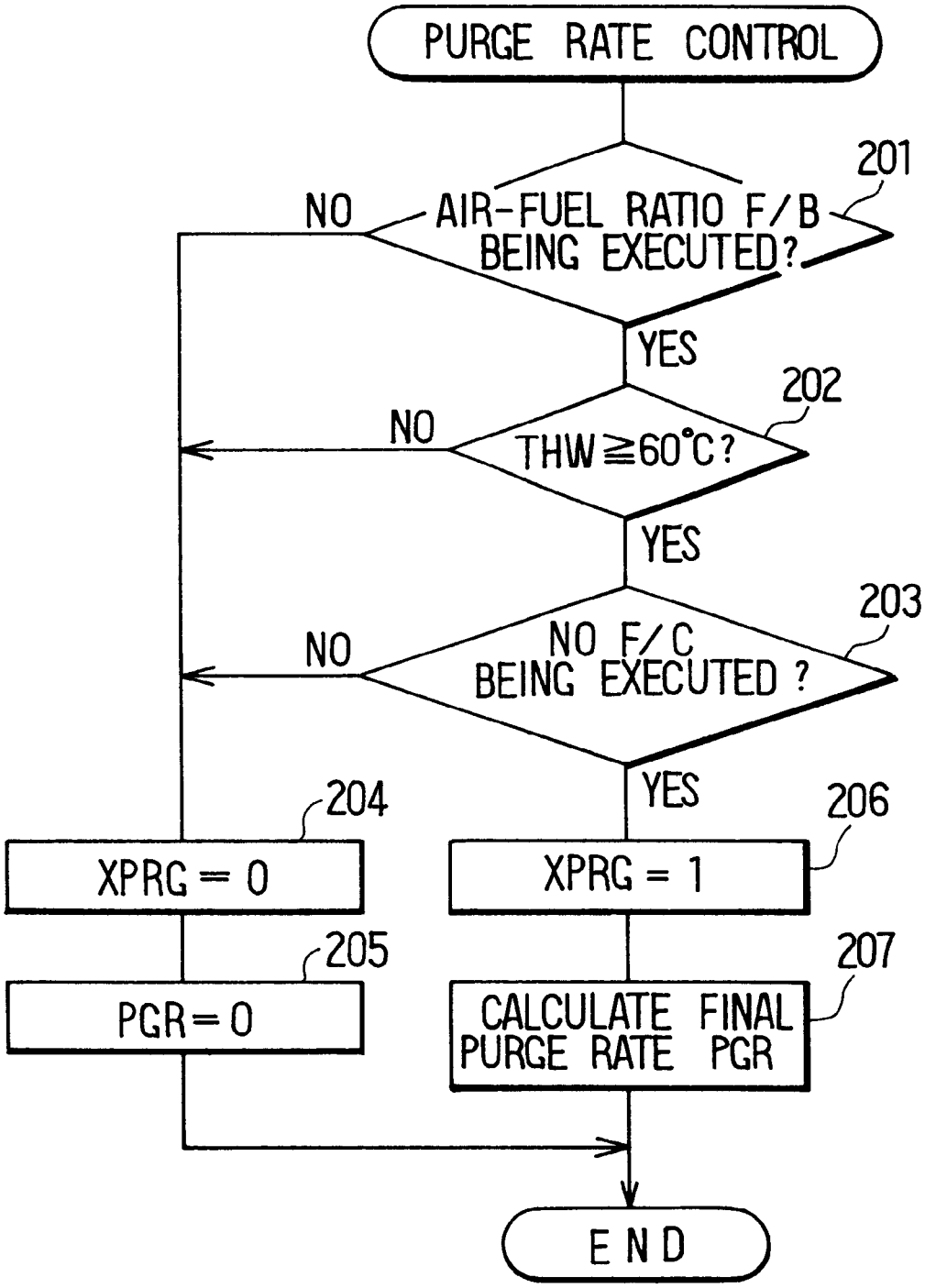
FIG. 5 is a flow diagram showing a purge rate control routine.

An explanation will be given for purge rate control, with reference to the flow diagram in FIG. 5. The routine shown in FIG. 5 is executed by the ECU 20 by time interruptions, for example, every 30 msec.

Accordingly, it is initially confirmed whether the air-fuel ratio F/B is being carried out, the cooling water temperature THW is at or higher than 60° C., and fuel is not being cut (steps 201–203). When any of steps 201–203 is determined to be NO, the operation proceeds to steps 204 and 205, sets a purge execution flag XPRG to "0" and sets a final purge rate PGR "0" to thereby finish the processing. That is, purging is not carried out.

Further, when all of steps 201–203 are determined to be YES, the operation proceeds to step 206, sets the purge execution flag XPRG to "1" and calculates the final purge rate PGR at step 207. Although in this embodiment there is no restriction regarding the method of calculating the final purge rate PGR, as an example, a fully open purge rate PGRMX, a target purge rate PGRO and a purge rate gradual change value PGRD are calculated, and a minimum value of these is determined as the final purge rate PGR.

In this case, the fully open purge rate PGRMX indicates a ratio of the total air amount flowing into the engine 1 via the intake pipe 2 versus a purge flow rate flowing via the purge pipe 11 when the purge solenoid valve 16 is fully opened (when duty is 100%). The value is determined from a map based on, for example, an intake pressure PM and an engine rotational number NE.

Further, the target purge rate PGRO is a purge rate expressing how much fuel vapor is to be replenished by purging when it is assumed that the injection amount is fully reduced to a predetermined target TAU correction amount KTPRG. In this embodiment, the target purge rate PGRO is calculated by dividing the target TAU correction amount KTPRG by an evaporation concentration average value FGPGAV (PGRO=KTPRG/FGPGAV). Accordingly, under the same operational state, the larger the FGPGAV value, the smaller the PGRO value. Further, the FGPGAV value corresponds to an amount of fuel vapor (evaporation gas) adsorbed to the canister 13 and is predicted as will be discussed later.

Further, when the purge rate is abruptly and significantly changed, correction of the injection amount does not catch up therewith, and an optimum air-fuel ratio cannot be maintained. Hence, the purge rate gradual change value PGRD is a control value to avoid the abrupt change, and PGRD is set in accordance with a deviation amount of the air-fuel ratio correction coefficient FAF. For example, when the deviation amount of the FAF value is comparatively small, a value produced by adding a predetermined value (for example, 0.1%) to the final purge rate PGR at a preceding time is set to the current purge rate gradual change value PGRD. When the deviation amount of the FAF value is comparatively large, a value produced by subtracting a predetermined value (for example, 0.1%) from the final purge rate PGR at the preceding time is set to the purge rate gradual change value PGRD at the current time.

When the final purge rate PGR is calculated as described above, purge control is carried out by the final purge rate PGR. Further, normally, the final purge rate PGR is controlled by the purge rate gradual change value PGRD, and when the purge rate gradual change value PGRD continues to increase, an upper limit of the final purge rate PGR is guarded by the fully open purge rate PGRMX or the target purge rate PGRO.

(Evaporation concentration detection)

Figure 6:
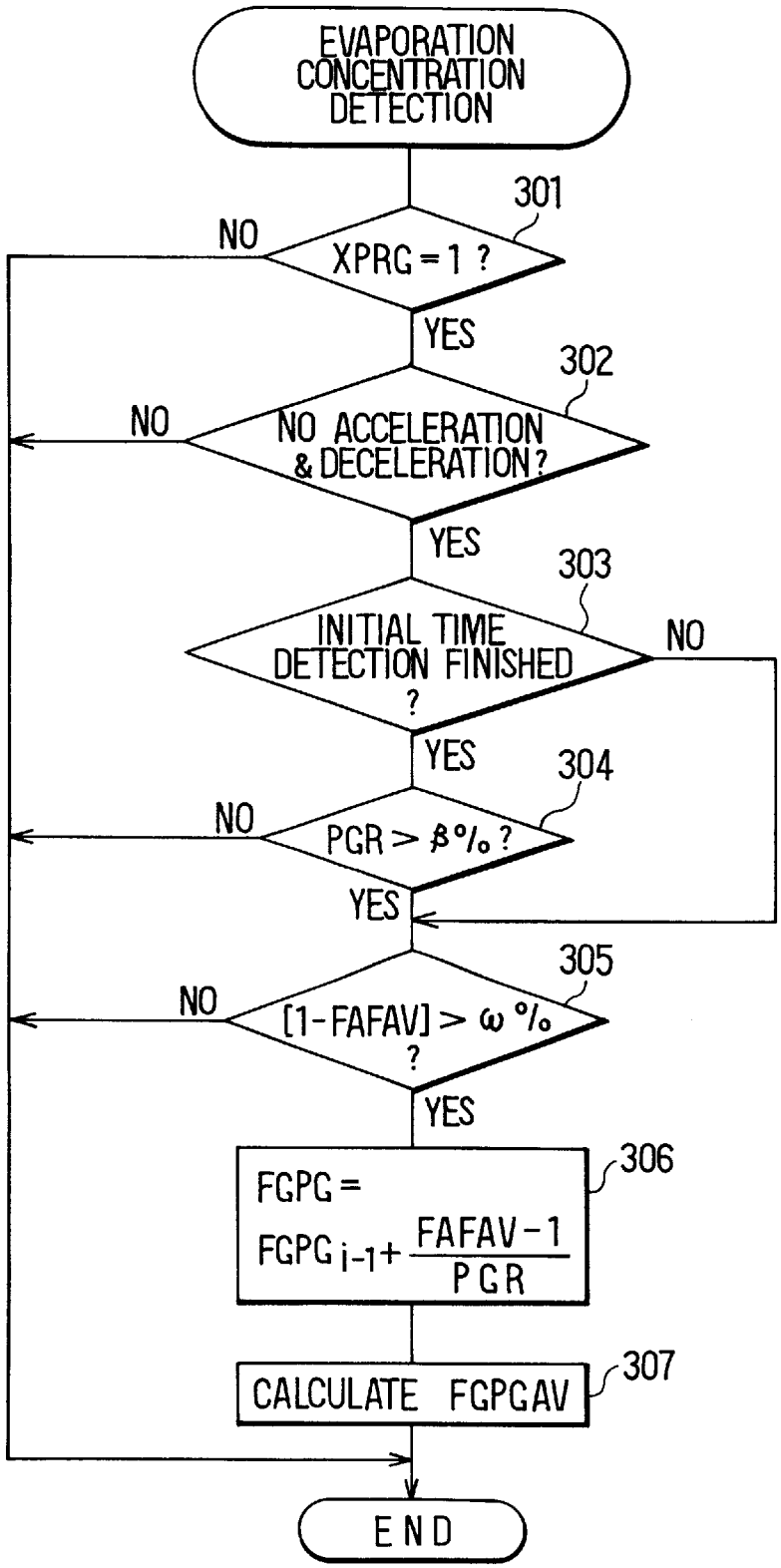
FIG. 6 is a flow diagram showing an evaporation concentration detecting routine.

An explanation will be given of the evaporation concentration detection in reference to the flow diagram of FIG. 6. A routine of FIG. 6 is executed by time interruption, for example, every 4 msec by the ECU 20. Further, according to the routine, when the key switch is turned on, an evaporation concentration FGPG and an evaporation concentration average value FGPGAV are respectively initialized to "0". By initializing FGPG and FGPGAV to "0", a fuel adsorption amount of the canister 13 is assumed to be "0" when the engine is started.

According to the routine shown in FIG. 6, at step 301, it is determined whether the purge execution flag XPRG is "1" and at step 302, whether the vehicle is not accelerating or decelerating (transient state of engine operation) is determined. In this case, when both steps 301 and 302 are determined to be YES, the operation proceeds to step 303, and when either of steps 301 and 302 is determined to be NO, the routine is finished as it is. That is, the evaporation concentration detection is prohibited when the purging operation is not yet executed or when the vehicle is accelerating or decelerating to thereby inhibit erroneous detection.

At step 303, it is determined whether the initial time detection of the evaporation concentration has been finished. When the engine is started, the concentration detection has not been finished yet. Accordingly, the operation proceeds to step 305 to determine whether the rounded value FAFAV of the FAF value is provided with a deviation equal to or larger than a predetermined value ω% (for example, 2%) in respect of a reference value (1). When the deviation amount of air-fuel ratio by evaporation purging is excessively small, the evaporation concentration cannot be detected correctly. Accordingly, when the deviation amount of the air-fuel ratio is small ($|1-FAFAV| \leqq \omega$), the processing ends. Further, when the deviation amount of the air-fuel ratio is large ($|1-FAFAV| > \omega$), the operation proceeds to step 306, where the evaporation concentration FGPG is calculated based on the following equation.

$$FGPG = FGPGi - 1 + (FAFAV - 1)/PGR$$

In the above equation, when the air-fuel ratio is rich ($FAFAV-1<0$), a value of the evaporation concentration FGPG is reduced by a value produced by dividing "FAFAV−1" by the final purge rate PGR. Further, when the air-fuel ratio is lean, ($FAFAV-1>0$), a value of the evaporation concentration FGPG is increased by a value produced by dividing "FAFAV−1" by the final purge rate PGR.

Finally, at step 307, in order to average the evaporation concentration FGPG at the current time, a predetermined rounding calculation (for example, a 1/64 rounding calculation) is executed to thereby calculate the evaporation concentration average value FGPGAV. Thereafter, the routine ends.

Incidentally, prior to finishing the initial time detection of the evaporation concentration, it is determined whether a detection value of the evaporation concentration is stabilized from a change amount between a preceding detection value and a current detection value of the evaporation concentration FGPG. When the detection value of the evaporation concentration is determined to stabilize, the initial time detection of the evaporation concentration subsequently ends.

When the initial time concentration detection ends in this way, thereafter, the determination at step 303 is YES at every time. At step 304, it is determined whether the final purge rate PGR exceeds a predetermined value β (for example, 0%). Further, only in the case of PGR>β, evaporation concentration detection at step 305 and thereafter is executed. That is, there is a case when even when the purge execution flag XPRG is set, when the final purge rate PGR becomes "0" and evaporation purging is not carried out. Therefore, the concentration detection is not carried out in the case of PGR≦β (0%) except in the case of initial time detection. Or at step 304, the predetermined value β is set to, for example, a value of 0–2%, and when the final purge rate PGR is small, that is, when the purge solenoid value 16 is disposed on the low flow rate side, the evaporation concentration detection is not carried out. As a result, the reliability of the evaporation concentration detection is increased.

An explanation will now be given for determination processing of air-fuel ratio learning conditions with reference to a flow diagram of FIG. 7. A routine of FIG. 7 is executed by time interruption at, for example, every 32 msec by ECU 20.

Figure 7:
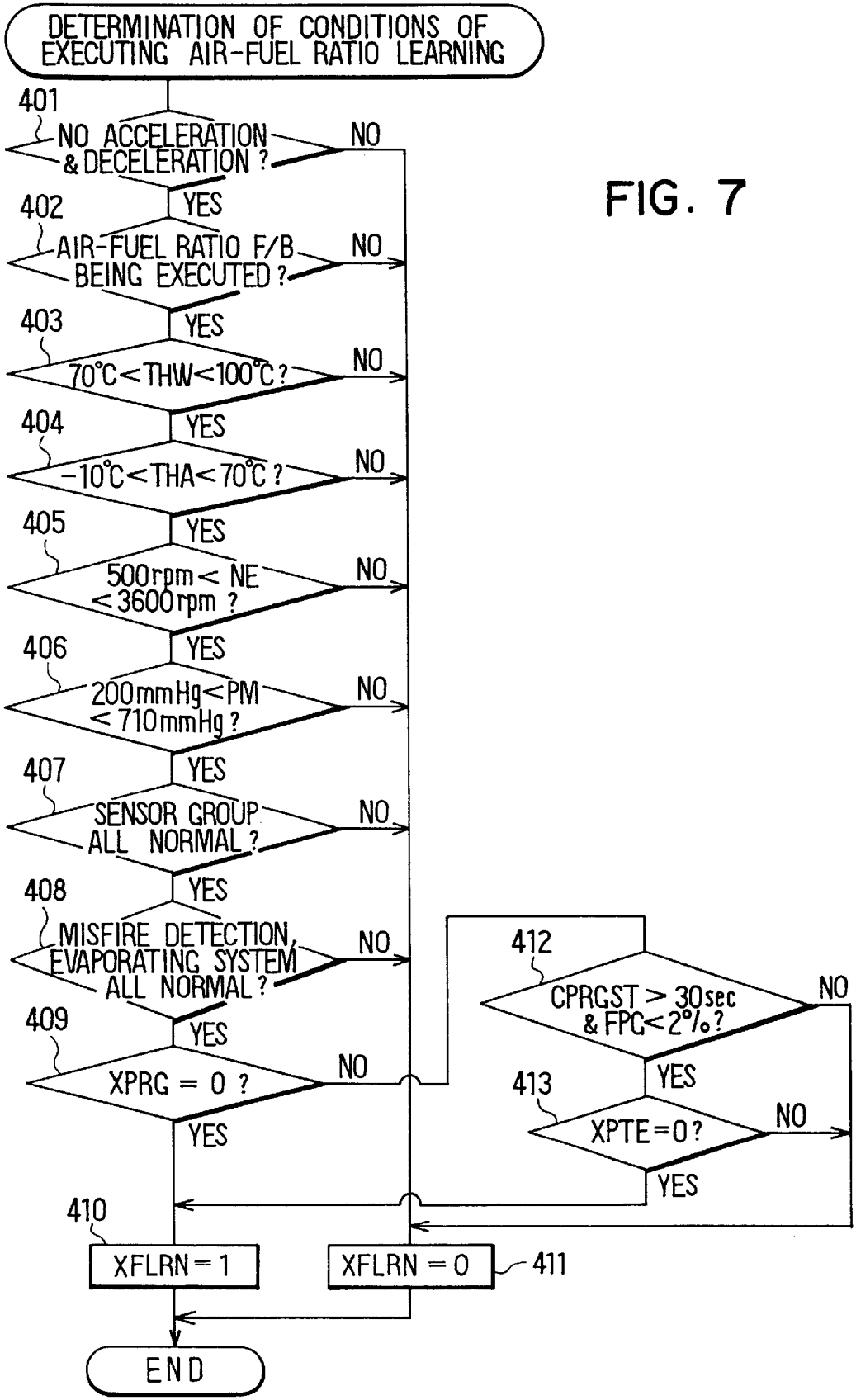
FIG. 7 is a flow diagram showing a routine for determining conditions for executing air-fuel ratio learning.

In the routine of FIG. 7, initially, at steps 401–409, premise conditions are determined. That is:

At step 401, whether the engine is not accelerating or decelerating is determined.

At step 402, whether air-fuel ratio F/B is being carried out is determined.

At step 403, whether cooling water temperature THW falls in a predetermined range (70–100° C.) is determined.

At step 404, whether intake air temperature THA falls in a predetermined range (−10–70° C.) is determined.

At step 405, whether the engine rotational number NE falls in a predetermined range (500–3600 rpm) is determined.

At step 406, whether the intake pipe inner pressure PM falls in a predetermined range (200–710 mmHg) is determined.

At step 407, whether a group of various sensors related to the air-fuel ratio control (for example, intake pressure sensor, cooling water temperature sensor, intake air temperature sensor, $O_2$ sensor and the like) are all normal is determined.

At step 408, whether failure in respect of the air-fuel ratio control (for example, misfire or abnormality in evaporation gas system) occurs is determined.

At step 409, whether the purge execution flag EPRG is "0" is determined.

Further, when all the determinations at steps 401–409 are YES, processing proceeds to step 410 and sets air-fuel ratio learning execution flag XFLRN to "1". That is, execution of the air-fuel ratio learning is permitted. Further, when any of steps 401–408 is NO, the operation proceeds to step 411 and sets the air-fuel ratio learning execution flag XFLRN to "0". That is, execution of the air-fuel ratio learning is prohibited.

Figure 9:
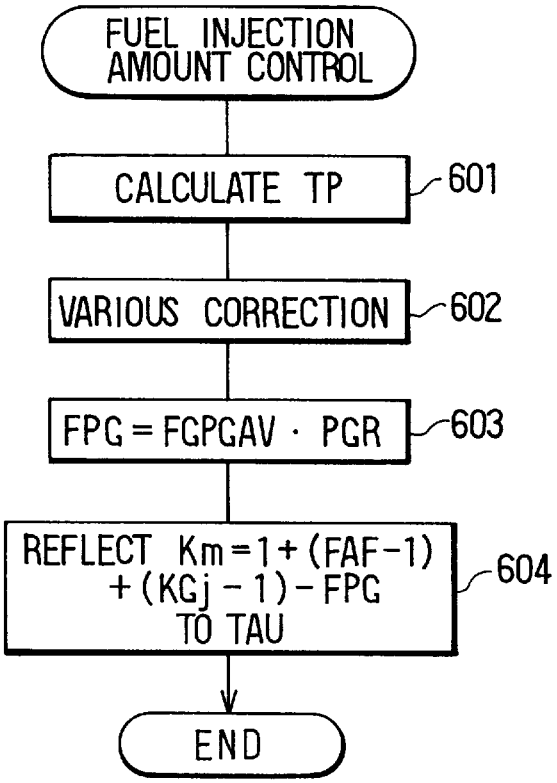
FIG. 9 is a flow diagram showing a fuel injection amount control routine.

Further, when only step 409 is NO, conditions at steps 412 and 413 are determined. At step 412, it is determined whether the purge execution accumulation time period CPRGST summed up from engine start exceeds 30 seconds and whether the purge correction coefficient FPG is less than "2%". In this case, the purge correction coefficient FPG signifies an amount of replenished fuel by executing purge under the conditions of determining by the purge rate control processing and an amount of fuel in correspondence with the coefficient is corrected to reduce the basic fuel injection amount TP. Incidentally, the FPG value is calculated at a fuel injection amount control routine (FIG. 9).

That is, after engine start, an amount of purging fuel vapor is large due to the fuel vapor adsorbed to the canister 13 while the engine has been stopped, and the fuel injection amount is corrected to reduce by the amount of fuel corresponding thereto. Accordingly, when CPRGST≦30 seconds or FPG≧2% (when the determination at step 412 is NO), the operation proceeds to step 411 and clears the air-fuel ratio learning execution flag XFLRN to "0" to thereby prohibit execution of air-fuel ratio learning.

Figure 11:
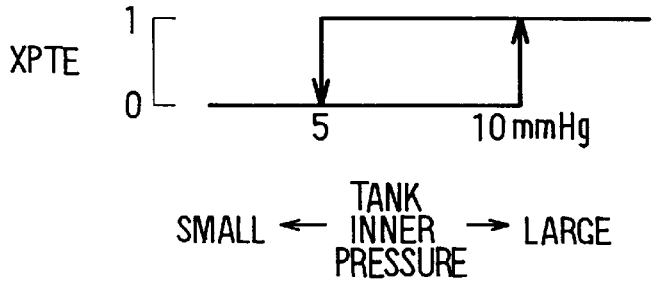
FIG. 11 is a diagram showing a behavior of operating a tank inner pressure flag XPTE in accordance with tank inner pressure.

Further, when CPRGST>30 seconds and FPG<2% (when the determination at step 412 is YES), the operation proceeds to step 413, and it is determined whether tank inner pressure determination flag XPTE for prohibiting or permitting to update the air-fuel ratio learning value KG based on tank inner pressure is "0". The tank inner pressure determination flag XPTE is operated by whether the tank inner pressure reaches the pressure for opening the tank inner pressure-regulating valve 30. That is, as shown by FIG. 11, when the tank inner pressure reaches 10 mmHg, the flag XPTE is set to "1", and when the tank inner pressure is lowered to 5 mmHg from that state, the flag XPTE is cleared to "0".

Further, when XPTE=0, the operation proceeds to step 410 and sets the air-fuel ratio learning execution flag XFLRN to "1" to thereby permit execution of air-fuel ratio learning. Further, when XPTE=1, the operation proceeds to step 411 and clears the air-fuel ratio learning execution flag XFLRN to "0" to thereby prohibit execution of the air-fuel ratio learning.

Figure 12:
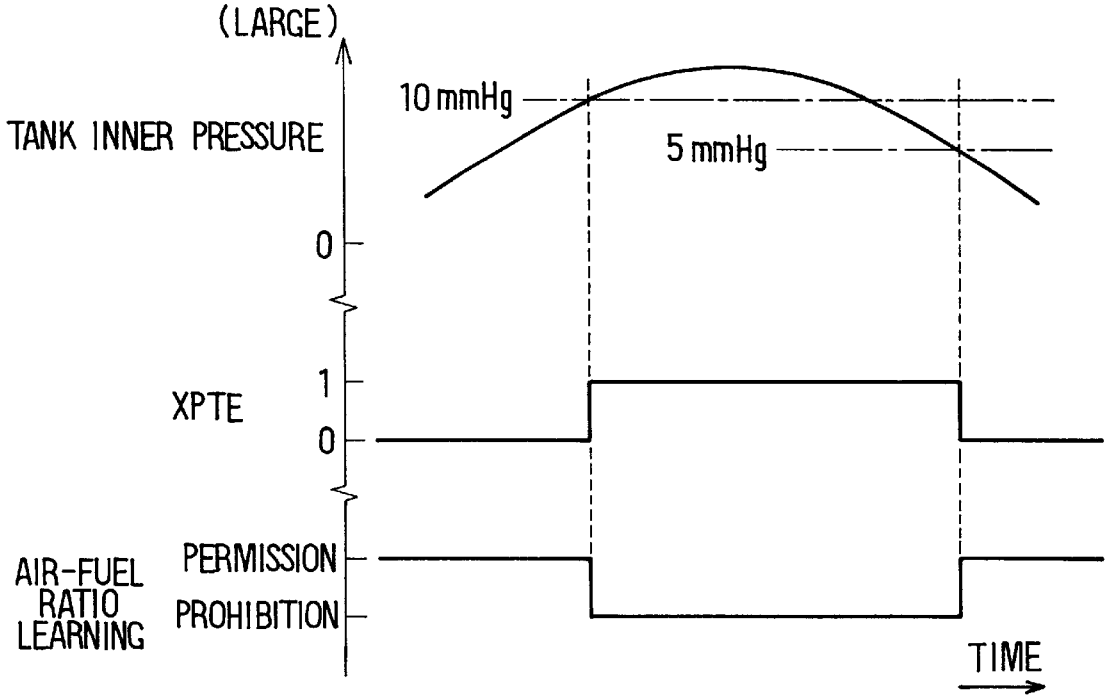
FIG. 12 illustrates timing diagrams showing a permitted state and a prohibited state of executing air-fuel ratio learning.

According to the above-described processing, as shown by time charts of FIG. 12, determination of the learning execution conditions having the following hysteresis characteristic is carried out.

The air-fuel ratio learning is permitted before the tank inner pressure is increased to 10 mmHg.

The air-fuel ratio learning is prohibited when the tank inner pressure is increased to 10 mmHg.

Thereafter, when the tank inner pressure is decreased to 5 mmHg, the air-fuel ratio learning is permitted again.

An explanation will be given now for the air-fuel ratio learning control with reference to FIG. 8.

Figure 8:
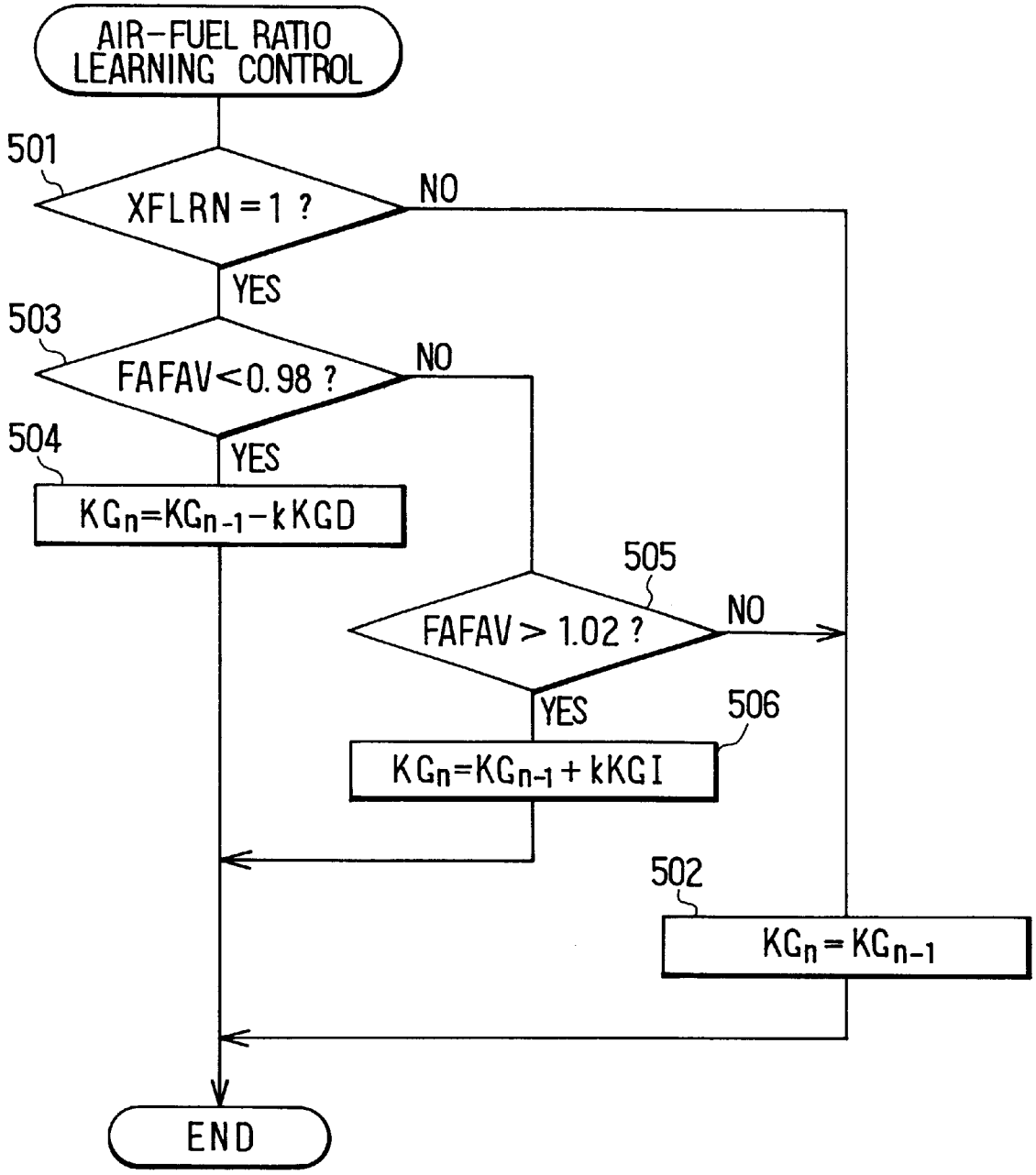
FIG. 8 is a flow diagram showing an air-fuel ratio learning control routine.

The routine shown in FIG. 8 is executed by time interruption at, for example, every 32 msec by ECU 20.

In the routine of FIG. 8, initially, at step 501, whether the air-fuel ratio learning execution flag XFLRN is "1" is determined. When XFLRN=0, the operation proceeds to step 502, holds the air-fuel ratio learning value KG at the time value (sets to KGn=KGn−1) and thereafter finishes the routine. Incidentally, the air-fuel ratio learning value KG is backup data stored to be held in a memory in ECU 20 and is a coefficient set to each engine operation region.

Further, when XFLRN=1, at step 503, the rounded value FAFAV (the value calculated at step 106 of FIG. 4) of the value of the air-fuel ratio correction coefficient FAF is used, and whether the FAFAV value is less than "0.98" is determined. When FAFAV<0.98, at step 504, a predetermined learning value updating amount kKGD is subtracted from a preceding time value KGn−1 of the air-fuel ratio learning value to thereby calculate a current time value KGn of the air-fuel ratio learning value (KGn=KGn−1−kKGD) and thereafter the routine ends.

Further, when FAFAV≧0.98, it is determined at step 505 whether the FAFAV value exceeds "1.02" is determined. Further, when FAFAV>1.02, at step 506, a predetermined learning value updating amount kKGI is added to the preceding time value KGn−1 of the air-fuel ratio learning value to thereby calculate the current time value KGn of the air-fuel ratio learning value (KGn=KGN−1+kKGI), and thereafter the routine ends.

Further, when 0.98≦FAFAV≦1.02 (when both determinations at steps 503 and 505 are NO), the operation proceeds to step 502. Further, the air-fuel ratio learning value KG is held at a value of the time (sets to KGn=KGn−1) and the routine ends.

An explanation will be now be given for the fuel injection amount control, with reference to the flow diagram of FIG. 9. A routine of FIG. 9 is executed by time interruption at, for example, every 4 msec by ECU 20.

In the routine of FIG. 9, at step 601, the basic fuel injection amount TP is calculated by referring to the map based on the engine rotational number NE and the load (for example, intake pressure PM). Next, at step 602, various basic corrections (cooling water temperature correction, post-starting correction, intake air temperature correction) are executed related to the operational state of the engine 1. At successive step 603, a purge correction coefficient FPG is calculated in accordance with the evaporation concentration average value FGPGAV calculated in the routine of FIG. 6 and the final purge rate PGR calculated in the routine of FIG. 5 (FPG=FGPGAV×PGR).

Thereafter, at step 604, a correction coefficient Km is calculated by the following equation from the air-fuel ratio correction coefficient FAF, the purge correction coefficient FPG and the air-fuel ratio learning value KGj, and the basic fuel injection amount TP is multiplied by the correction coefficient Km to thereby reflect to the basic fuel injection amount TAU.

$$Km=1+(FAF-1)+(KGj-1)-FPG$$

Further, fuel injection is carried out by the injector 4 based on the fuel injection amount TAU at a predetermined fuel injection timing.

Figure 10:
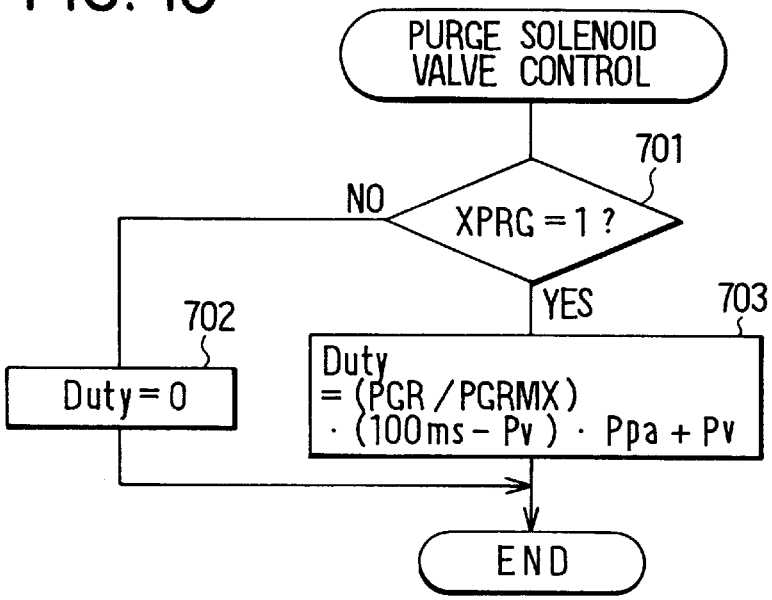
FIG. 10 is a flow diagram showing a purge solenoid valve control routine.

Next, an explanation of purge solenoid valve control will now be given with reference to the flow diagram of FIG. 10. A routine of FIG. 10 is executed by time interruption at, for example, every 100 msec by ECU 20.

At step 701, whether the purge execution flag XPRG is "1" is determined. When XPRG=0, the operation proceeds to step 702 and sets a control value Duty for driving the purge solenoid valve 16 to "0". Further, when XPRG=1, the operation proceeds to step 703 and calculates the control value Duty by the following equation based on the final purge rate PGR and the fully opening purge rate PGRMX compatible with the operational state at that time.

$$\text{Duty}=(PGR/PGRMX)\times(100-Pv)\times Ppa+Pv$$

In the above equation, the period for driving the purge solenoid valve 16 is 100 msec. Further, notation Pv designates a voltage correction value with respect to a variation in battery voltage (an amount corresponding to the time for correcting the driving period), and notation Ppa designates an atmospheric pressure correction value with respect to a variation in the atmospheric pressure. Based on the control value Duty, the duty ratio of the drive pulse signal of the purge solenoid valve 16 is set.

According to the above-described embodiment the present invention includes the following features.

(a) When the tank inner pressure exceeds a predetermined criterion value, the tank inner pressure determination flag XPTE is operated, and updating of the air-fuel ratio learning value KG is prohibited in accordance with the state of the flag XPTE. In this case, while monitoring the actual amount of fuel vapor fed to the side of the canister 13, the air-fuel ratio learning value can be updated properly in accordance with the amount of the fuel vapor. Accordingly, even when various fuels having different volatilities are used, permission or prohibition of updating the learning value can properly be determined. That is, even when a relationship between fuel temperature and a fuel evaporation amount significantly differs depending on the kind of fuel, the limitations exhibited by conventional control methods are avoided. As a result, erroneous learning is prevented while properly setting a learning frequency, and highly accurate air-fuel ratio control can be executed.

(b) Hysteresis is provided to the criterion value of the tank inner pressure to prohibit updating the learning value in accordance with rise of the tank inner pressure and to permit updating of the learning value in accordance with fall of the tank inner pressure. Accordingly, repetition of unnecessary prohibition and permission of updating the learning value are avoided.

(c) The tank inner pressure-regulating valve 30 is installed, and is opened when the tank inner pressure becomes the predetermined pressure. When the tank inner pressure becomes larger than the pressure of opening the tank inner pressure-regulating valve 30, the air-fuel ratio learning value is prohibited from being updated. In this case, the air-fuel ratio learning value is prohibited from being updated as a reflection of the operation in which the fuel vapor is actually introduced from the fuel tank 7 to the canister 13. Accordingly, erroneous learning is further avoided.

(d) The tank inner pressure-regulating valve 30 is opened at the comparatively low pressure P1 when the engine is operated, and is opened at the comparatively high pressure P2 when the engine is stopped. Accordingly, during engine operation, even when leakage failure is caused in the purge pipe 11, large amounts of fuel vapor can be prevented from entering the atmosphere. Further, when the engine is stopped, an amount of fuel vapor generated in the fuel tank 7 can be reduced, and downsizing of the canister 13 can be achieved.

Next, an explanation will be given of a second embodiment of the present invention. Incidentally, portions of the second embodiment identical to those in the above-described first embodiment are labeled with identical notations in the drawings, and an explanation thereof will therefore be omitted. Further, an explanation will be given centering on points of difference from the first embodiment as follows.

Figure 13:
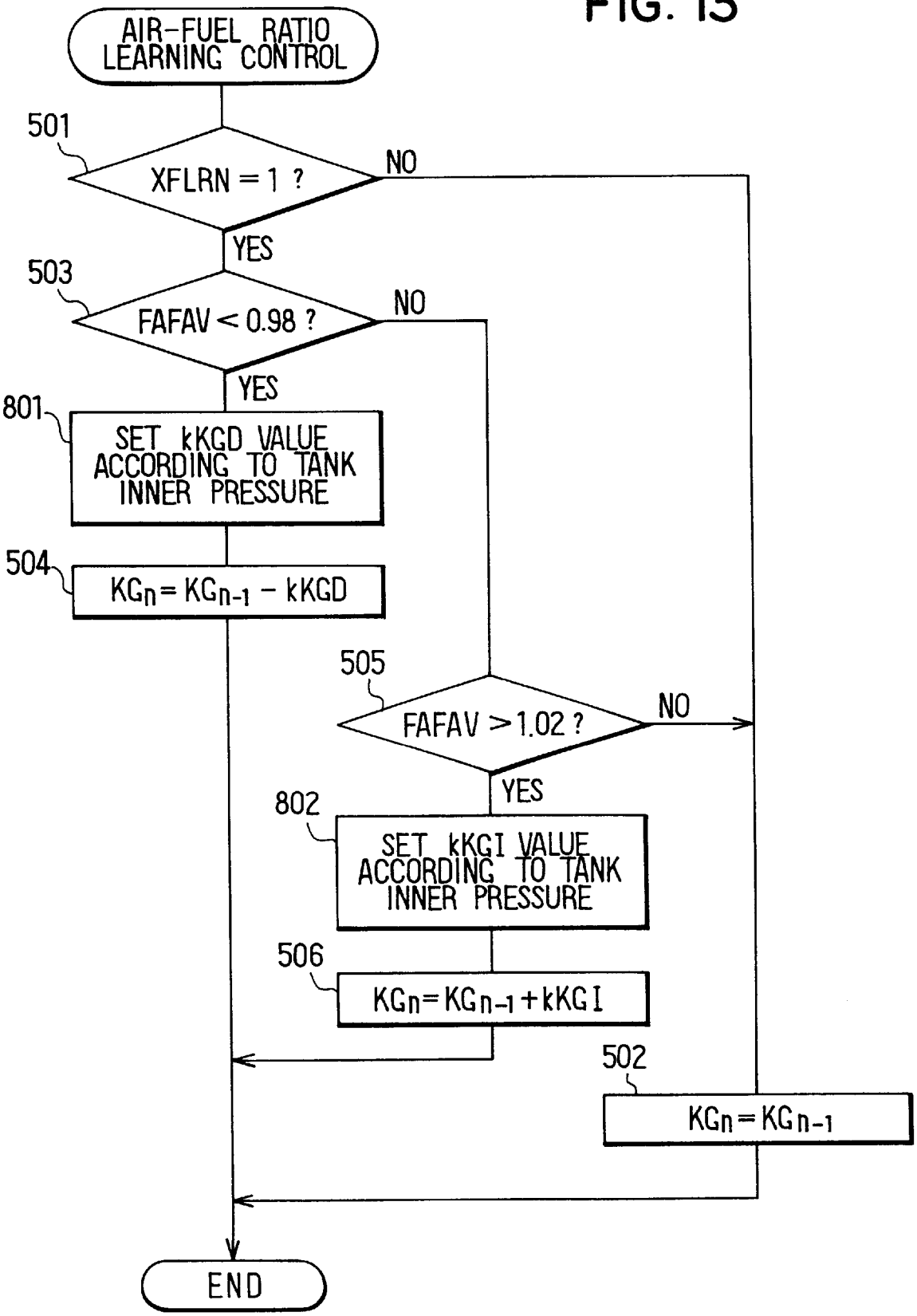
FIG. 13 is a flow diagram showing an air-fuel ratio learning control routine according to a second embodiment.

According to the second embodiment, setting and determining of the tank inner pressure determination flag XPTE are canceled and the air-fuel ratio learning execution flag XFLRN is set to "0" or "1" only via steps 401–409 and 412 of FIG. 7. Further, in place of the processing of FIG. 8, the processing of FIG. 13 is carried out.

A description will be given of points of difference from FIG. 8 with respect to an air-fuel ratio learning control routine of FIG. 13. When updating of the air-fuel ratio learning value is permitted (when XFLRN=1), at step 801, a learning value updating amount kKGD (reduction width) is set in accordance with the tank inner pressure. Or, at step 802, a learning value updating amount kKGI (addition width) is set in accordance with the tank inner pressure. Further, the air-fuel ratio learning value KG is updated by using the learning value updating amounts kKGD and kKGI (steps 504, 506).

Figure 14:
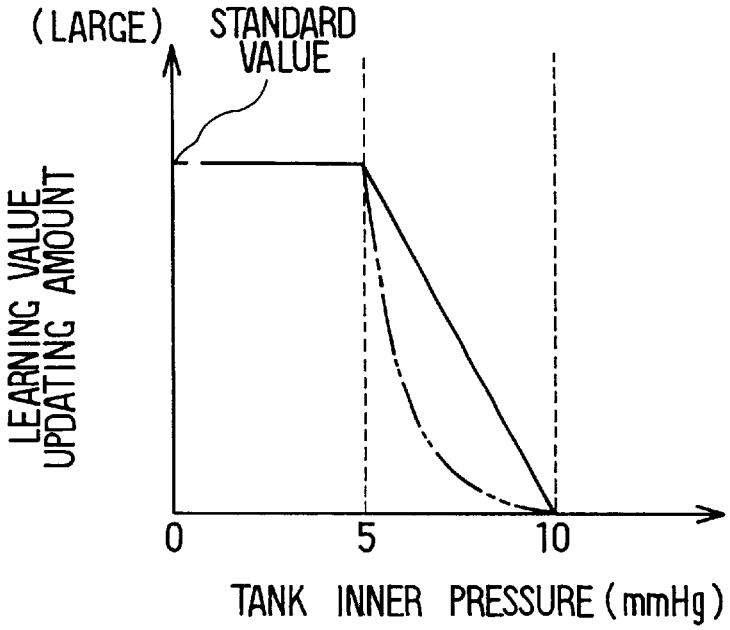
FIG. 14 is a diagram showing a relationship between tank inner pressure and a learning value updating amount.
Figure 15:
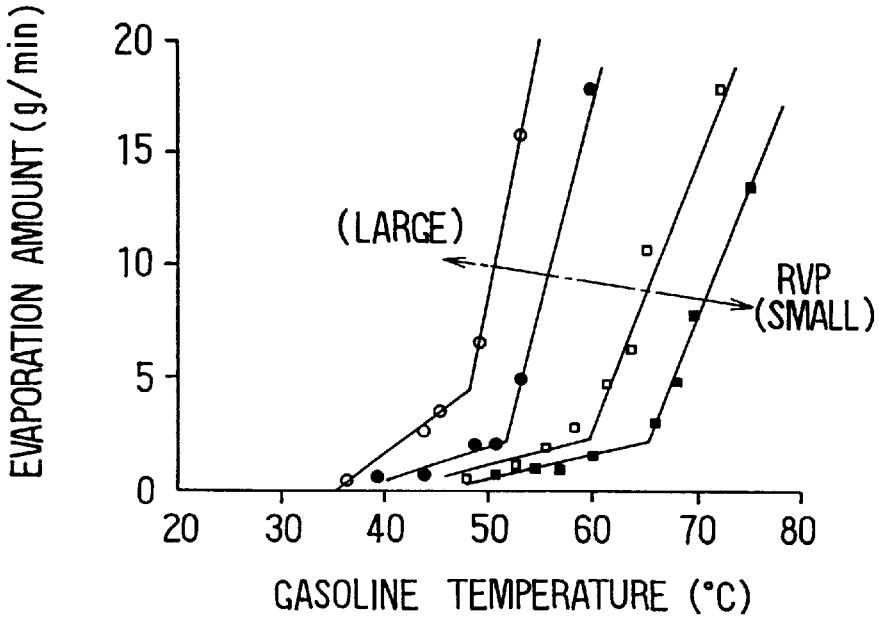
FIG. 15 is a diagram showing a relationship among gasoline temperature, Reid vapor pressure and a fuel evaporation amount.

The learning value updating amounts kKGD and kKGI are set by using, for example, a relationship represented by the bold line in FIG. 14. That is, when tank inner pressure<5 mmHg, the learning value updating amount is set to a standard value. Further, when tank inner pressure<5–10 mmHg, the learning value updating amount is set variably in accordance with the tank inner pressure. When tank inner pressure>10 mmHg, the learning value updating amount is set to "0". In this case, a characteristic may be provided as represented by the double-dotted chain line when tank inner pressure=5–10 mmHg.

That is, according to the second embodiment, an updating amount variable range (region of tank inner pressure=5–10 mmHg) is provided between a permission region and a prohibition region to update the learning value.

According to the present embodiment, similar to the first embodiment, erroneous learning is prevented while a learning frequency is being properly set. Accordingly, highly accurate air-fuel ratio control can be carried out. Further, in this case, the updating amount is set variably such that the higher the tank inner pressure, the smaller the learning value updating amount. Therefore, the frequency of updating the learning value is further increased, and an optimum air-fuel ratio learning value can be stored in the memory.

In this case, by providing the updating amount variable region for variably setting the learning value updating amount between the region of permitting and the region of prohibiting to update the learning value, fine processing of updating the learning value can be executed in accordance with the amount of fuel vapor.

Further, the invention can be also realized through the following additional embodiments.

According to the first embodiment, updating of the air-fuel ratio learning value is prohibited or permitted in accordance with whether the tank inner pressure is higher than the predetermined values (10, 5 mmHg) while providing the hysteresis characteristic (refer to FIG. 7, FIG. 12). However, during the processing of FIG. 7, when the tank inner pressure determination flag XPTE is set, the hysteresis characteristic may alternatively not be provided. That is, the flag XPTE is operated in accordance with whether the tank inner pressure is higher than a predetermined value (for example, 10 mmHg). In this case, when tank inner pressure<10 mmHg, the learning value is permitted to be updated, and when tank inner pressure≧10 mmHg, the learning value is prohibited from being updated. Accordingly, processing is simplified.

In the processing of FIG. 7, the air-fuel ratio learning conditions (steps 401–409 and 412) are not limited thereto, but can be changed or omitted according to to various control specifications. Further, in FIG. 12, the tank inner pressure criterion value for prohibiting/ permitting air-fuel ratio learning is not limited thereto.

Although according to the first embodiment, the pressure for opening the tank inner pressure-regulating valve 30 and the value for determining to permit or prohibit to update the air-fuel ratio learning value are identical, the criterion value may be alternatively be set to a value slightly higher than the pressure of opening the tank inner pressure-regulating valve 30.

Also, the tank inner pressure-regulating valve is not limited to the above-described structure, but may be other constitution. In sum, the valve may be opened or closed in accordance with tank inner pressure and may be operated mechanically or may be electromagnetically driven.

While the above description constitutes the preferred embodiment of the present invention, it should be appreciated that the invention may be modified without departing from the proper scope or fair meaning of the accompanying claims. Various other advantages of the present invention will become apparent to those skilled in the art after studying the foregoing text and drawings taken in conjunction with the following claims.

What is claimed is:

1. An engine air-fuel ratio control apparatus for causing fuel vapor generated in a fuel tank to be adsorbed before discharging the adsorbed fuel vapor to an engine intake system, said apparatus comprising:

calculating means for calculating a feedback correction amount based on an exhaust gas oxygen concentration;

executing means for executing air-fuel ratio feedback control using the feedback correction amount;

learning means for updating an air-fuel ratio learning value for air-fuel ratio control by using the feedback correction amount during air-fuel ratio feedback control execution;

detecting means for detecting a pressure in the fuel tank; and prohibiting means for prohibiting the air-fuel ratio learning value from being updated by the learning means when the detected tank inner pressure exceeds a predetermined criterion value and when the adsorbed fuel vapor is discharged to the engine intake system.

2. The air-fuel ratio control apparatus of claim 1, wherein the prohibiting means provides hysteresis in the criterion value in prohibiting the learning value from being updated in accordance with an increase in the tank inner pressure, and in permitting the learning value to be updated in accordance with a decrease in the tank inner pressure.

3. The air-fuel ratio control apparatus of claim 1, further comprising:

a tank inner pressure-regulating valve installed between the fuel tank and the canister that is opened when the tank inner pressure reaches a predetermined pressure;

wherein the prohibiting means prohibits the air-fuel ratio learning value from being updated when the detected tank inner pressure is larger than a pressure for opening the tank inner pressure-regulating valve.

4. The air-fuel ratio control apparatus of claim 3, wherein the pressure-regulating valve is opened at a comparatively low pressure P1 during engine operation, and is otherwise opened at a comparatively high pressure P2.

5. The air-fuel ratio control apparatus of claim 1, wherein the executing means is for generating an air-fuel ratio flag when a feedback condition exists, and for changing the feedback correction amount based on the air-fuel ratio flag.

6. An engine air-fuel ratio control apparatus for causing fuel vapor generated in a fuel tank to be adsorbed before discharging the adsorbed fuel vapor to an engine intake system, said apparatus comprising:

calculating means for calculating a feedback correction amount based on an exhaust gas oxygen concentration;

executing means for executing air-fuel ratio feedback control using the feedback correction amount;

learning means for updating an air-fuel ratio learning value for air-fuel ratio control by using the feedback correction amount during the feedback control;

detecting means for detecting a pressure in the fuel tank; and updating amount setting means for setting an updating amount of the air-fuel ratio learning value such that the updating amount is inversely proportional to the detected tank inner pressure, setting the updating amount being prohibited when the adsorbed fuel vapor is discharged to the engine intake system.

7. The air-fuel ratio control apparatus of claim 6, wherein the updating amount setting means includes an updating amount variable region for variably setting the updating amount of the learning value between a region permitting the learning value to be updated and a region prohibiting the learning value from being updated.

8. A method of controlling an air-fuel ratio of an internal combustion engine, comprising:

calculating a feedback correction amount for adsorbed fuel vapor to be discharged based on an exhaust gas oxygen concentration;

updating an air-fuel ratio learning value for air-fuel ratio control by using the feedback correction amount when the air-fuel ratio feedback control is being carried out;

detecting fuel tank inner pressure; and prohibiting the air-fuel ratio learning value from being updated when the detected tank inner pressure exceeds a predetermined criterion value and when the adsorbed fuel vapor is discharged to the engine intake system.

9. The method of claim 8, further providing hysteresis in the criterion value to prohibit the learning value from being updated in accordance with a rise in the tank inner pressure and to permit the learning value to be updated in accordance with a fall in the tank inner pressure.

10. The method of claim 8, wherein the step of calculating comprises generating an air-fuel ratio flag when a feedback condition exists, and changing the feedback correction amount based on the air-fuel ratio flag.

11. A method of controlling an air-fuel ratio of an internal combustion engine, comprising:

calculating a feedback correction amount for adsorbed fuel vapor to be discharged based on an exhaust gas oxygen concentration;

updating an air-fuel ratio learning value for air-fuel ratio control by using the feedback correction amount when the air-fuel ratio feedback control is being carried out;

detecting fuel tank inner pressure; and setting an updating amount of the air-fuel ratio learning value such that the updating amount is inversely proportional to the detected tank inner pressure, setting the updating amount being prohibited when the adsorbed fuel vapor is discharged to the engine intake system.

* * * * *